US008789343B2

(12) United States Patent
Zurn et al.

(10) Patent No.: US 8,789,343 B2
(45) Date of Patent: Jul. 29, 2014

(54) GLAZING UNIT SPACER TECHNOLOGY

(71) Applicant: Cardinal IG Company, Eden Prairie, MN (US)

(72) Inventors: Benjamin J. Zurn, Roseville, MN (US); Gary R. Matthews, Des Plaines, IL (US); John Brian Shero, Savage, MN (US)

(73) Assignee: Cardinal IG Company, Eden Prairie, MN (US)

( * ) Notice: Subject to any disclaimer, the term of this patent is extended or adjusted under 35 U.S.C. 154(b) by 0 days.

(21) Appl. No.: 13/713,984

(22) Filed: Dec. 13, 2012

(65) Prior Publication Data

US 2014/0165484 A1 Jun. 19, 2014

(51) Int. Cl.

| | |
|---|---|
| ***E06B 7/00*** | (2006.01) |
| ***E04C 2/54*** | (2006.01) |
| ***E06B 3/00*** | (2006.01) |
| ***E06B 3/66*** | (2006.01) |
| ***E06B 3/663*** | (2006.01) |

(52) U.S. Cl.

CPC .. *E06B 3/663* (2013.01); *E06B 3/66* (2013.01)
USPC ..... 52/786.13; 52/204.593; 428/34

(58) Field of Classification Search

CPC . E06B 3/663; E06B 3/66309; E06B 3/66314; E06B 3/66323; E06B 3/66352; E06B 3/67313; E06B 2003/663; E06B 2003/66309; E06B 2003/6639
USPC ..... 52/204.593, 204.599, 204.6, 204.62, 52/786.1, 786.13, 788.1; 428/34
See application file for complete search history.

(56) References Cited

U.S. PATENT DOCUMENTS

| | | | |
|---|---|---|---|
| 32,436 | A | 5/1861 | Scofield |
| 367,236 | A | 7/1887 | Einhaedt |
| 423,704 | A | 3/1890 | Simpson |
| 767,883 | A | 8/1904 | Grafton |
| 1,015,429 | A | 1/1912 | Fahrney |
| 1,018,399 | A | 2/1912 | Livingston |
| 1,310,206 | A | 7/1919 | Mowat |
| 1,425,207 | A | 8/1922 | Milner |
| 1,617,069 | A | 2/1927 | McLaughlin |
| 2,235,680 | A | 3/1941 | Haven |
| 2,251,967 | A | 8/1941 | Yoder |
| 2,597,097 | A | 5/1952 | Haven |
| 2,618,819 | A | 11/1952 | Goodwillie |
| 2,684,266 | A | 7/1954 | Englehart |

(Continued)

FOREIGN PATENT DOCUMENTS

| | | |
|---|---|---|
| CA | 1290624 | 10/1991 |
| CA | 2275448 | 7/1998 |

(Continued)

OTHER PUBLICATIONS

English-language abstract for DE10011759.

(Continued)

*Primary Examiner* — Ryan Kwiecinski
(74) *Attorney, Agent, or Firm* — Fredrikson & Byron, PA

(57) ABSTRACT

The invention provides a spacer having an engineered wall with multiple corrugation fields including first and second corrugation fields having differently configured corrugations. Also provided are multi-pane glazing units that incorporate such a spacer.

36 Claims, 5 Drawing Sheets

(56) References Cited

U.S. PATENT DOCUMENTS

| | | | | |
|---|---|---|---|---|
| 2,708,774 | A | 5/1955 | Seelen | |
| 2,723,427 | A | 11/1955 | Bobel | |
| 2,833,031 | A | 5/1958 | Flumerfelt | |
| 2,838,809 | A | 6/1958 | Zeolla | |
| 2,838,810 | A | 6/1958 | Englehart | |
| 3,027,608 | A | 4/1962 | Ryan | |
| 3,030,673 | A | 4/1962 | London | |
| 3,045,297 | A | 7/1962 | Ljungdahl | |
| 3,105,274 | A | 10/1963 | Armstrong | |
| 3,143,009 | A | 8/1964 | Joachim | |
| 3,280,523 | A | 10/1966 | Stroud | |
| 3,367,161 | A | 2/1968 | Avakian | |
| 3,474,513 | A | 10/1969 | Allingham | |
| 3,758,996 | A | 9/1973 | Bowser | |
| 3,839,137 | A | 10/1974 | Davis | |
| 3,842,647 | A | 10/1974 | Knudson | |
| 3,921,359 | A | 11/1975 | Brichard | |
| 3,956,998 | A | 5/1976 | Bavetz | |
| 3,971,243 | A | 7/1976 | Jones | |
| 3,981,111 | A | 9/1976 | Berthagen | |
| 4,027,517 | A | 6/1977 | Bodnar | |
| 4,057,944 | A | 11/1977 | Wyatt, Jr. | |
| 4,057,945 | A | 11/1977 | Kessler | |
| 4,080,482 | A | 3/1978 | Lacombe | |
| 4,098,722 | A | 7/1978 | Cairns | |
| 4,113,905 | A | 9/1978 | Kessler | |
| 4,222,209 | A | 9/1980 | Peterson | |
| 4,222,213 | A | 9/1980 | Kessler | |
| 4,233,833 | A | 11/1980 | Balinski | |
| 4,241,146 | A | 12/1980 | Sivachenko | |
| 4,261,145 | A | 4/1981 | Brocking | |
| 4,322,926 | A | 4/1982 | Wolflingseder | |
| 4,400,338 | A | 8/1983 | Rundo | |
| 4,431,691 | A | 2/1984 | Greenlee | |
| 4,450,706 | A | 5/1984 | Engelmohr | |
| 4,453,855 | A | 6/1984 | Richter | |
| 4,468,905 | A | 9/1984 | Cribben | |
| 4,499,703 | A | 2/1985 | Rundo | |
| 4,530,195 | A | 7/1985 | Leopold | |
| 4,536,424 | A | 8/1985 | Laurent | |
| 4,551,364 | A | 11/1985 | Davies | |
| 4,567,710 | A | 2/1986 | Reed | |
| 4,576,841 | A | 3/1986 | Lingemann | |
| 4,658,553 | A | 4/1987 | Shinagawa | |
| 4,683,634 | A | 8/1987 | Cole | |
| 4,719,728 | A | 1/1988 | Eriksson | |
| 4,720,950 | A | 1/1988 | Bayer | |
| 4,753,096 | A | 6/1988 | Wallis | |
| 4,762,743 | A | 8/1988 | Von Alven | |
| 4,770,018 | A | 9/1988 | Bosl | |
| 4,791,773 | A | 12/1988 | Taylor | |
| 4,808,452 | A | 2/1989 | McShane | |
| 4,831,799 | A | 5/1989 | Glover | |
| 4,835,130 | A | 5/1989 | Box | |
| 4,835,926 | A | 6/1989 | King | |
| 4,850,175 | A | 7/1989 | Berdan | |
| 4,862,666 | A * | 9/1989 | Kero | 52/630 |
| 4,994,309 | A | 2/1991 | Reichert | |
| 4,998,392 | A | 3/1991 | Massarelli | |
| 5,079,054 | A | 1/1992 | Davies | |
| 5,080,146 | A | 1/1992 | Arasteh | |
| 5,087,489 | A | 2/1992 | Lingemann | |
| 5,088,258 | A | 2/1992 | Schield | |
| 5,120,584 | A | 6/1992 | Ohlenforst | |
| 5,144,780 | A | 9/1992 | Gieling | |
| 5,209,034 | A | 5/1993 | Box | |
| 5,209,599 | A | 5/1993 | Kronenberg | |
| 5,295,292 | A | 3/1994 | Leopold | |
| 5,313,762 | A | 5/1994 | Guillemet | |
| 5,377,473 | A | 1/1995 | Narayan | |
| 5,439,716 | A | 8/1995 | Larsen | |
| 5,443,871 | A | 8/1995 | Lafond | |
| 5,460,862 | A | 10/1995 | Roller | |
| 5,466,534 | A | 11/1995 | Newby | |
| 5,487,937 | A | 1/1996 | Newby | |
| 5,512,341 | A | 4/1996 | Newby | |
| 5,553,440 | A | 9/1996 | Bulger | |
| 5,560,731 | A | 10/1996 | Kronenberg | |
| 5,567,258 | A | 10/1996 | Lee | |
| 5,568,714 | A | 10/1996 | Peterson | |
| 5,581,971 | A | 12/1996 | Peterson | |
| 5,617,699 | A | 4/1997 | Thompson | |
| 5,630,306 | A | 5/1997 | Wylie | |
| 5,644,894 | A | 7/1997 | Hudson | |
| 5,658,645 | A | 8/1997 | Lafond | |
| 5,713,177 | A | 2/1998 | Peterson | |
| 5,759,665 | A | 6/1998 | Lafond | |
| 5,813,191 | A | 9/1998 | Gallagher | |
| 5,819,499 | A | 10/1998 | Evason | |
| 5,851,609 | A | 12/1998 | Baratuci | |
| 5,890,289 | A | 4/1999 | Guillemet | |
| 5,962,090 | A | 10/1999 | Trautz | |
| 6,035,602 | A | 3/2000 | Lafond | |
| 6,038,825 | A | 3/2000 | Shah | |
| 6,061,994 | A | 5/2000 | Goer | |
| 6,115,989 | A | 9/2000 | Boone | |
| 6,131,364 | A * | 10/2000 | Peterson | 52/786.13 |
| 6,197,129 | B1 | 3/2001 | Zhu | |
| 6,266,940 | B1 | 7/2001 | Reichert | |
| 6,289,641 | B1 | 9/2001 | McCandless | |
| 6,351,923 | B1 | 3/2002 | Peterson | |
| 6,355,328 | B1 | 3/2002 | Baratuci | |
| 6,370,838 | B1 | 4/2002 | Evason | |
| 6,415,561 | B2 | 7/2002 | Thompson | |
| 6,497,130 | B2 | 12/2002 | Nilsson | |
| 6,581,341 | B1 | 6/2003 | Baratuci | |
| 6,737,129 | B2 | 5/2004 | Bayer | |
| 6,823,644 | B1 | 11/2004 | Peterson | |
| 6,877,292 | B2 | 4/2005 | Baratuci | |
| 6,989,188 | B2 | 1/2006 | Brunnhofer | |
| 7,043,881 | B2 | 5/2006 | Krause | |
| 7,107,729 | B2 | 9/2006 | Baratuci | |
| 7,132,151 | B2 | 11/2006 | Rasmussen | |
| 7,445,682 | B2 | 11/2008 | James | |
| 7,493,739 | B2 | 2/2009 | Baratuci | |
| 7,743,584 | B2 * | 6/2010 | Reichert et al. | 52/745.15 |
| 7,757,455 | B2 | 7/2010 | Gallagher | |
| 7,827,760 | B2 | 11/2010 | Brunnhofer | |
| 7,827,761 | B2 | 11/2010 | Buchanan | |
| 7,856,791 | B2 | 12/2010 | Rosskamp | |
| 7,908,820 | B2 * | 3/2011 | Catalano | 52/786.13 |
| 8,114,488 | B2 | 2/2012 | Alvarez | |
| 8,151,542 | B2 | 4/2012 | Trpkovski | |
| 8,181,499 | B2 | 5/2012 | Ingvarsson | |
| 8,622,115 | B2 * | 1/2014 | Seebald | 165/8 |
| 2001/0001357 | A1 | 5/2001 | Reichert | |
| 2004/0079047 | A1 * | 4/2004 | Peterson | 52/786.13 |
| 2005/0166546 | A1 | 8/2005 | Reichert | |
| 2006/0037262 | A1 | 2/2006 | Siebert | |
| 2006/0104710 | A1 * | 5/2006 | Lafond | 403/205 |
| 2007/0227097 | A1 | 10/2007 | Gallagher | |
| 2008/0053037 | A1 | 3/2008 | Gallagher | |
| 2009/0120018 | A1 | 5/2009 | Trpkovski | |
| 2009/0120019 | A1 | 5/2009 | Trpkovski | |
| 2009/0120035 | A1 | 5/2009 | Trpkovski | |
| 2009/0123694 | A1 * | 5/2009 | Trpkovski | 428/119 |
| 2010/0031591 | A1 | 2/2010 | Gallagher | |
| 2010/0065580 | A1 | 3/2010 | McGlinchy et al. | |
| 2010/0255224 | A1 | 10/2010 | Gubbels | |
| 2011/0104512 | A1 | 5/2011 | Rapp | |
| 2011/0296796 | A1 | 12/2011 | Lenhardt | |
| 2011/0303349 | A1 | 12/2011 | Nieminen | |
| 2012/0141699 | A1 | 6/2012 | Mader | |
| 2012/0151857 | A1 * | 6/2012 | Heikkila et al. | 52/204.593 |
| 2013/0042552 | A1 * | 2/2013 | Trpkovski et al. | 52/204.593 |
| 2013/0047404 | A1 * | 2/2013 | Nieminen et al. | 29/428 |
| 2014/0109499 | A1 * | 4/2014 | Nieminen et al. | 52/204.593 |

FOREIGN PATENT DOCUMENTS

| | | |
|---|---|---|
| CA | 2314053 A1 | 1/2001 |
| CA | 2502069 | 9/2006 |
| CA | 2303464 | 5/2007 |
| CA | 2518821 | 7/2011 |

(56) References Cited

FOREIGN PATENT DOCUMENTS

| | | | |
|---|---|---|---|
| CA | 2725881 | | 1/2013 |
| DE | 6903785 | U | 7/1969 |
| DE | 6903785 | | 10/1969 |
| DE | 1904907 | | 8/1970 |
| DE | 1904907 | A1 | 8/1970 |
| DE | 2152071 | | 2/1973 |
| DE | 2152071 | A1 | 2/1973 |
| DE | 7322123 | U | 2/1974 |
| DE | 2356544 | | 5/1975 |
| DE | 2356544 | A1 | 5/1975 |
| DE | 8204453 | U1 | 6/1982 |
| DE | 8204453 | | 7/1982 |
| DE | 3529434 | A1 | 2/1986 |
| DE | 3529403 | | 4/1986 |
| DE | 3529403 | A1 | 4/1986 |
| DE | 4101277 | | 7/1992 |
| DE | 4101277 | A1 | 7/1992 |
| DE | 29506746 | U1 | 7/1995 |
| DE | 19642669 | | 3/1998 |
| DE | 19642669 | C1 | 3/1998 |
| DE | 20014789 | U1 | 11/2000 |
| DE | 10011759 | | 9/2001 |
| DE | 10011759 | A1 | 9/2001 |
| DE | 20200349 | U1 | 5/2003 |
| EP | 0054251 | A1 | 6/1982 |
| EP | 0054251 | | 2/1985 |
| EP | 0139262 | | 12/1987 |
| EP | 0268886 | | 1/1994 |
| EP | 0500483 | | 8/1995 |
| EP | 0500483 | B1 | 8/1995 |
| FR | 2276450 | | 1/1976 |
| FR | 2276450 | A1 | 1/1976 |
| FR | 2525314 | | 10/1983 |
| FR | 2525314 | A1 | 10/1983 |
| GB | 2064631 | A | 6/1981 |
| GB | 2181773 | A | 4/1987 |
| WO | 8402482 | A | 7/1984 |
| WO | 8907495 | A | 8/1989 |
| WO | 9923339 | A | 5/1999 |
| WO | WO2004009944 | | 1/2004 |
| WO | 2011008860 | A | 1/2011 |
| WO | 2011091986 | A | 8/2011 |
| WO | 2011131700 | | 10/2011 |

OTHER PUBLICATIONS

English-language abstract for DE1904907.
English-language abstract for DE19642669.
English-language abstract for DE2152071.
English-language abstract for DE3529403.
English-language abstract for DE4101277.
English-language abstract for DE6903785.
English-language abstract for FR2525314.
English-language abstract for EP0054251.
English-language abstract for EP0500483.
Allmetal, Inc. Drawing PPD101024102011XXXE, Oct. 22, 1993.
Allmetal, Inc. Drawing Stainless Steel Products, Aug. 19, 1994.
English-language abstract for DE20200349.
English-language abstract for DE29506746.
English-language abstract for DE20014789.
English-language abstract for DE3529434.
English-language abstract for DE7322123.
Machine translation of German Patent No. DE8204453.
Machine translation of German Patent No. DE2356544.
English-language abstract for FR2276450.
Insulating Glass Production, Glass Digest, May 15, 1994.
Design U.S. Appl. No. 29/439,679, filed Dec. 13, 2012.
U.S. Trademark Application No. 85/803,270 filed Dec. 14, 2012.
U.S. Trademark Application No. 85/803,257 filed Dec. 14, 2012.
GED Integrated Solutions, "The Intercept Spacer System Is Always Your Best Choice," Window & Door, vol. 15, No. 2, Feb. 2007, 1 page.
truseal.com, "There is More Metal in Your CD Collection," Window & Door, vol. 15, No. 2, Feb. 2007, 1 page.
Technoform, "Technoform's I-Spacer," Window & Door, vol. 15, No. 9, Oct. 2007, p. 96.
Alumet Mfg., Inc., "Structural Warm-Edge Stainless Spacer for High Rise Buildings," Window & Door, vol. 16, No. 2, Feb. 2008, back cover, 1 page.
Allmetal, "Aluminum Air Spacer," http://www.allmetalinc.com/AirSpacers/AluminumDefault.aspx, 1 page, printed on Apr. 8, 2014.
Efficient Windows Collaborative, "Window Technologies: Low Conductance Spacers," http://www.efficientwindows.org/spacers.php, 2 pages, printed on Apr. 8, 2014.
Quanex, "Rigid Spacers," https://www.quanex.conn/Products/Insulating-Glass-Systenns/Single-Seal-Spacers/Rigid-Spacers.aspx, 1 page, printed on Apr. 8, 2014.
Quanex, "Duaraseal," https://www.quanex.com/Products/Insulating-Glass-Systems/Single-Seal-Spacers/Duraseal.aspx, 1 page, printed on Apr. 8, 2014.
Quanex, "Dual Seal Spacers," https://www.quanex.com/Products/Insulating-Glass-Systems/Dual-Seal-Spacers.aspx, 1 page, printed on Apr. 8, 2014.
Swisspacer, "Warm Edge," http://www.swisspacer.com/en/knowledge-centre/warm-edge, 2 pages, printed on Apr. 8, 2014.
Technoform Glass Insulation, "What is Warm Edge," http://www.tgi-spacer.com, 1 page, printed on Apr. 8, 2014.
English-language abstract for DE10011759, dated Sep. 27, 2001.
English-language abstract for DE1904907, dated Aug. 13, 1970.
English-language abstract for DE19642669, dated Mar. 5, 1998.
English-language abstract for DE2152071, dated Feb. 22, 1973.
English-language abstract for DE3529403, dated Apr. 17, 1986.
English-language abstract for DE4101277, dated Jul. 23, 1992.
English-language abstract for DE6903785, dated Jul. 31, 1969.
English-language abstract for FR2525314, dated Oct. 21, 1983.
English-language abstract for EP0054251, dated Jun. 23, 1982.
English-language abstract for EP0500483, dated Aug. 9, 1995.
English-language abstract for DE20200349, dated May 22, 2003.
English-language abstract for DE29506746, dated Jul. 6, 1995.
English-language abstract for DE20014789, dated Nov. 23, 2000.
English-language abstract for DE3529434, dated Feb. 27, 1986.
English-language abstract for DE7322123, dated Feb. 7, 1974.
Machine translation of German Patent No. DE8204453, dated Jun. 3, 1982.
Machine translation of German Patent No. DE2356544, dated May 28, 1975.
English-language abstract for FR2276450, dated Jan. 23, 1976.

* cited by examiner

A
B
C
D
11
12
13
15
19
31
32
35
36
38
310
311
312
380

GLAZING UNIT SPACER TECHNOLOGY

FIELD OF THE INVENTION

The invention relates to a spacer for multi-pane glazing units. More specifically, the invention relates to a spacer having widthwise corrugations on at least one of its walls, and to a multi-pane glazing unit incorporating such a spacer.

BACKGROUND OF THE INVENTION

The present invention is in the field of glazing units having two, three or more panes that are spaced from one another by means of elongated spacers positioned between the panes.

Insulating glass units and other multi-pane glazing units generally have at least two parallel panes. A peripheral spacer, typically comprising metal, plastic, or both, is provided between the panes adjacent their edges to maintain the panes in a spaced-apart configuration. One or more sealants are usually provided between the panes and the sides of the spacer to seal the edges of the unit. The resulting seal provides resistance to water vapor and gas permeating into the between-pane space. In addition, when the between-pane space is filled with gas, the seal provides resistance to such gas escaping from the between-pane space.

The spacer itself may be provided in hollow, tubular form. In such cases, the spacer may have side walls adhered to the confronting pane surfaces by one or more beads of sealant material, such as polyisobutylene ("PIB"), silicone, or both. Commonly, a particulate desiccant is provided inside the spacer, and the spacer is provided with holes that enable gaseous communication between the interior of the spacer and the between-pane space of the glazing unit. The desiccant can thus extract water vapor from the between-pane space. Desiccant can be provided in other ways; it can be incorporated into the sealant, it can be provided in a matrix form in or on the spacer, etc.

The spacers in glazing units should have good durability, longevity, and lateral compression strength, i.e., good crush resistance. At the same time, these spacers should provide good thermal performance. For example, the spacer should provide a low level of thermal transfer from one side of the glazing unit to the other. Finally, the spacer should have good aesthetics.

SUMMARY OF THE INVENTION

Certain embodiments of the present invention provide a multi-pane glazing unit including first and second panes maintained in a spaced-apart configuration by a spacer located between the first and second panes. The glazing unit has a between-pane space with a width. The first and second panes have confronting surfaces facing the between-pane space. The spacer has two side regions sealed to edge regions of the confronting surfaces of the first and second panes. The spacer has an engineered wall that extends in a widthwise direction relative to the between-pane space. The engineered wall, when moving in the widthwise direction along the engineered wall, has multiple corrugation fields including a first corrugation field and a second corrugation field. The first corrugation field has a first set of widthwise corrugations, and the second corrugation field having a second set of widthwise corrugations. The first set of corrugations includes corrugations that are configured differently (e.g., are differently sized, differently shaped, or both) than corrugations of the second set of corrugations.

In another embodiment, the invention provides a spacer for a multi-pane glazing unit. The spacer has a length and a width. The spacer has an engineered wall that extends in a widthwise direction (i.e., generally extends in the spacer's width direction). The engineered wall, when moving in the widthwise direction along the engineered wall, has multiple corrugation fields including a first corrugation field and a second corrugation field. The first corrugation field has a first set of widthwise corrugations, and the second corrugation field has a second set of widthwise corrugations. The first set of corrugations includes corrugations that are configured differently (e.g., are differently sized, differently shaped, or both) than corrugations of the second set of corrugations.

DESCRIPTION OF THE DRAWINGS

The following drawings are illustrative of particular embodiments of the present invention and therefore do not limit the scope of the invention. The drawings are not necessarily to scale, and are intended for use in conjunction with the explanations in the following detailed description. Different embodiments of the invention will hereinafter be described in connection with the appended drawings, wherein like numerals denote like elements.

DESCRIPTION OF PREFERRED EMBODIMENTS

The following detailed description is exemplary in nature and is not intended to limit the scope, applicability, or configuration of the invention in any way. Rather, the following description provides practical illustrations for implementing exemplary embodiments of the invention. Examples of constructions, materials, dimensions, and manufacturing processes are provided for selected elements; all other elements employ that which is known to those of ordinary skill in the field of the invention. Those skilled in the present art will recognize that many of the noted examples have a variety of suitable alternatives.

Figure 1:
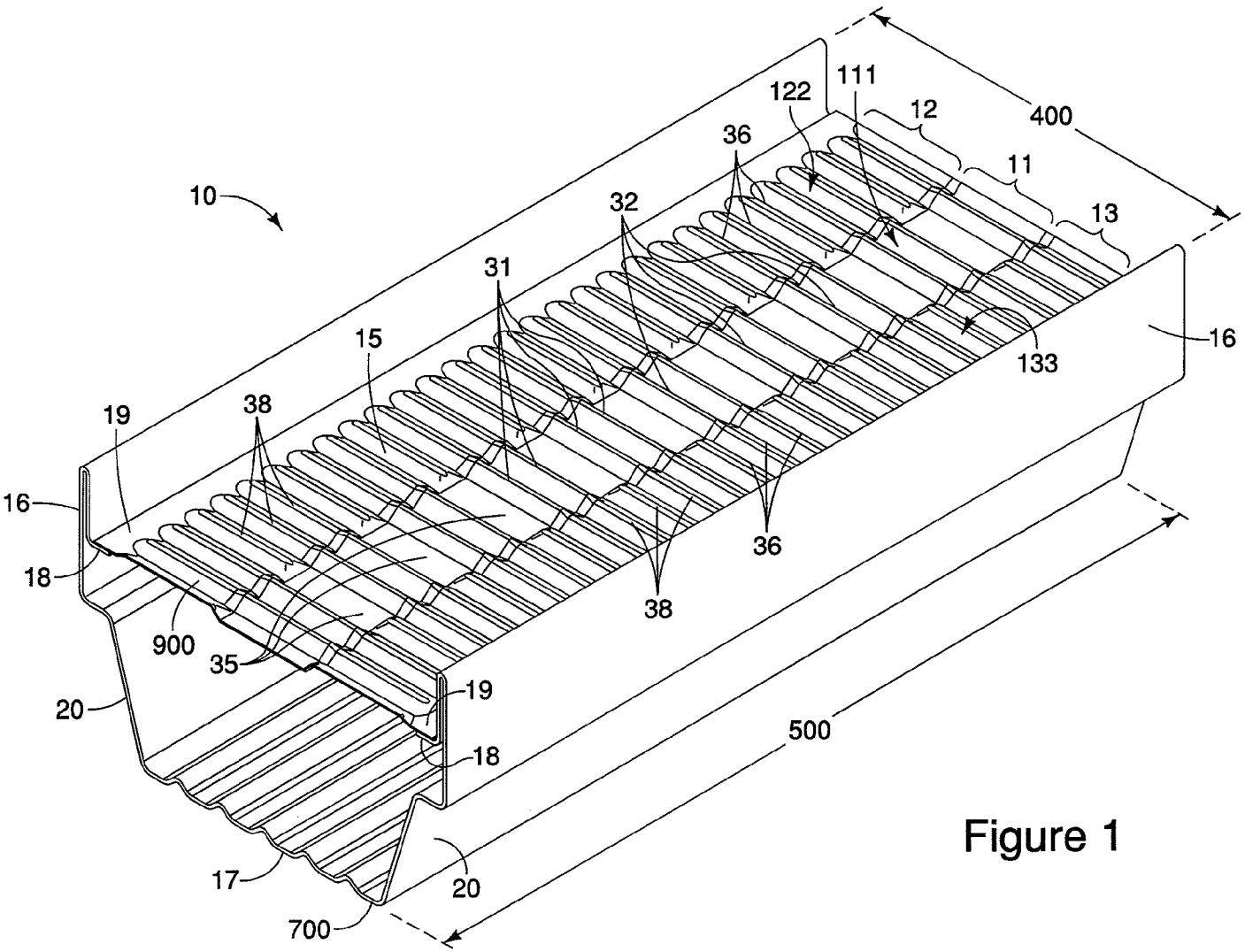
FIG. 1 is a perspective view of a section of a spacer in accordance with one embodiment of the present invention.

The invention provides a particularly advantageous spacer for use in multi-pane glazing units, such as insulating glass units. One embodiment of the spacer 10 is shown in FIGS. 1-4. Referring first to FIG. 1, it can be seen that the spacer 10 has a length 500 and a width 400. It will be appreciated that FIG. 1 shows merely a small length of the spacer 10. As will be readily apparent to skilled artisans, the spacer 10 will normally be much longer, typically having a length sufficient to extend entirely about a perimeter of the glazing unit 100 in which the spacer is intended for use. In certain examples, the length of the spacer 10 is greater than 40 inches, greater than 100 inches, greater than 110 inches, or greater than 150 inches. The spacer length, for example, can optionally be in the range of about 50 to 300 inches. The width 400 of the spacer 10 corresponds to the gap width (i.e., the width 410 of the between-pane space 150) that is desired for the glazing unit 100. In certain examples, the width 400 of the spacer 10 is in the range of about 4-50 mm, or about 5-30 mm. In one example, the width 400 of the spacer 10 is about 5-7 mm, such as 6.5 mm. In another example, the width 400 of the spacer 10 is about 12-14 mm, such as 13 mm. In still another example, the width 400 of the spacer 10 is about 20-22 mm, such as 21 mm. The spacer dimensions, however, can be varied outside the ranges noted above to accommodate the requirements of different glazing applications.

As shown in FIG. 1, the spacer 10 includes an engineered wall 15 that extends in a widthwise (or "lateral") direction. In other words, the engineered wall 15 extends in the spacer's width direction 400. When the spacer 10 is incorporated into a multi-pane glazing unit 100, the engineered wall 15 preferably extends across a width of the unit's between-pane space 150, e.g., so as to be substantially perpendicular to the confronting surfaces 41, 43 of two panes 42, 44 defining the between-pane space 150. Preferably, the engineered wall 15 extends in a direction that is generally perpendicular to side walls 16 of the spacer 10, that is generally parallel to an outer wall 17 of the spacer, or both.

The engineered wall 15, when moving in the widthwise direction along the engineered wall, has multiple corrugation fields including, at least, a first corrugation field 11 and a second corrugation field 12. These corrugations fields 11, 12 comprise differently configured (differently sized, differently shaped, or both) patterns formed in the engineered wall 15. In FIGS. 1-6, the first corrugation field 11 has a first set of widthwise corrugations 111, and the second corrugation field 12 has a second set of widthwise corrugations 122. The illustrated corrugations extend in the spacer's width direction (or "lateral direction"). These corrugations, for example, have peaks and valleys that are elongated in a lateral direction. In some cases, the corrugations are elongated in a direction substantially normal to side walls 16 of the spacer 10. If desired, the corrugations can be configured, not to extend straight across the width, but rather to extend at oblique angles across the width. The corrugations in a given corrugation field can be provided with different corrugation shapes, such as generally trapezoidal, triangular, arcuate (e.g., smooth, rounded waves), square, rectangular, or generally following a sine wave.

The first set of corrugations 111 includes corrugations that are configured differently (e.g., are differently sized, differently shaped, or both) than corrugations of the second set of corrugations 122. In FIGS. 1-4, the corrugations 111 in the first corrugation field 11 are larger than the corrugations 122 in the second corrugation field 12. Specifically, the corrugations 111 in the first corrugation field 11 have a greater corrugation height than the corrugations 122 in the second corrugation field 12. This, however, is not required in all embodiments.

By providing the engineered wall 15 with corrugation fields having differently configured corrugations, it is possible to adjust the thermal path of the spacer, the strength characteristics of the spacer, or both. Moreover, this can provide distinctive aesthetics, and the ability to modify the aesthetics of the spacer.

In the embodiment shown in FIGS. 1-4, the first set of corrugations 111 includes corrugations that are at least 0.002 inch larger than (and perhaps at least 0.0025 inch larger than, such as about 0.003 inch larger than) corrugations of the second set of corrugations 122. In the embodiment of FIGS. 1-4, the reported corrugation size is the distance from the top surface of a corrugation peak 31, 38 to the bottom surface of an adjacent corrugation valley 32, 36. FIG. 2D, for example, identifies the corrugation height (or "peak-to-peak amplitude") for the first corrugation field 11 using the reference number 311. The corrugation height 311 for the first set of corrugations 111 can optionally be in the range of 0.005 to 0.05 inch, or 0.01 to 0.02 inch, such as about 0.015 inch. The corrugation height for the second set of corrugations 122 can optionally be in the range of 0.004 to 0.04 inch, or 0.008 to 0.018 inch, such as about 0.012 inch. These ranges, however, are merely exemplary; many different corrugation sizes can be provided to accommodate the requirements of different embodiments.

In FIGS. 1-4, the first corrugation field 11 occupies a central width of the engineered wall 15 and extends along the entire length 500 of the spacer 10. The second corrugation field 12 occupies a side region of the engineered wall 15 and extends along the entire length 500 of the spacer 10. In the embodiment illustrated, this side region is adjacent to a side wall 16 of the spacer 10.

Figures 2, 2A, 2B, 2C, 2D:
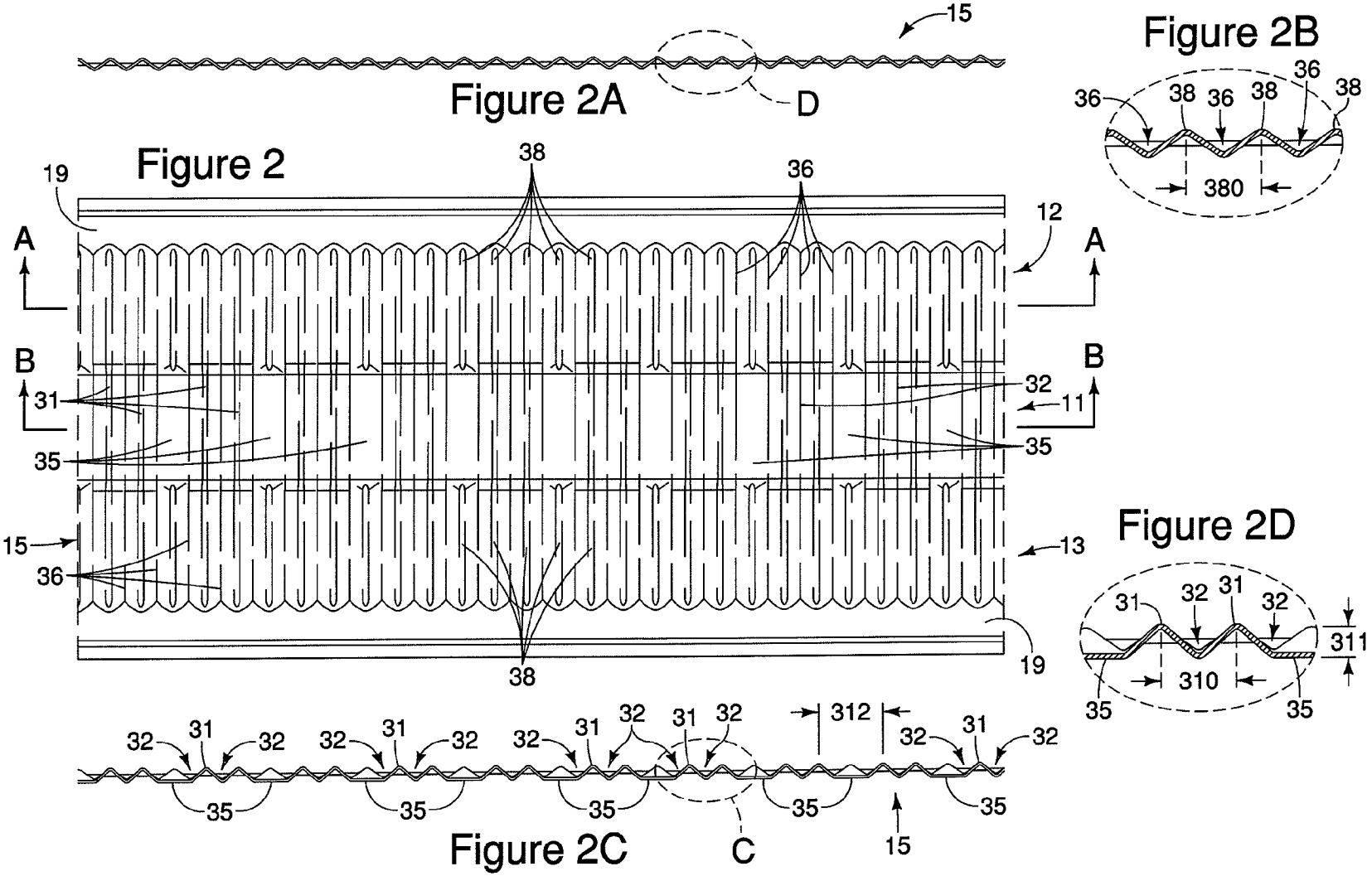
FIG. 2 is a plan view of the top wall of the spacer of FIG. 1.
FIG. 2A is a cross-sectional view, taken along lines A-A, of the top wall of FIG. 2.
FIG. 2B is a detail view of region D of the top wall of FIG. 2A.
FIG. 2C is a cross-sectional view, taken along lines B-B, of the top wall of FIG. 2.
FIG. 2D is a detail view of region C of the top wall of FIG. 2C.

The illustrated first set of corrugations 111 has a lower corrugation frequency than the second set of corrugations 122. The term "corrugation frequency" as used herein means the arithmetic average peak-to-peak period. The illustrated first set of corrugations 111 includes some "short" peak-to-peak periods (between the two peaks of each closely positioned peak pair) and some "long" peak-to-peak periods (between the two peaks of each peak pair separated by a flat 35). FIG. 2D identifies one of the short peak-to-peak periods of the first set of corrugations 111 using the reference number 310, and FIG. 2C identifies one of the long peak-to-peak periods using the reference number 312. Thus, the corrugation frequency for the first set of corrugations 111 factors in all the short periods and all the long periods in determining the arithmetic average peak-to-peak period.

The corrugation frequency of the second set of corrugations 122 preferably is higher (e.g., at least 20% higher, or at least 25% higher, such as about 33% higher) than that of the first set of corrugations 111. As best seen in FIG. 2, the second corrugation field 12 is corrugated on a continuous, uninterrupted basis over its entire length. In contrast, the first corrugation field 11 includes a series of non-corrugated wall regions spaced apart along the length of the spacer. These details, however, are not required in all embodiments. For example, this arrangement could be reversed, if so desired.

As best seen in FIGS. 1, 2, 2C, and 2D, the illustrated first corrugation field 11 includes a series of flats 35. The flats 35 are non-corrugated wall regions, each located between (and separating) two laterally spaced-apart corrugation peaks 31. Preferably, each flat 35 comprises (e.g., is) a planar wall section. The illustrated flats 35 are surrounded on all sides by corrugation, although this is not strictly required. The flats 35 in the illustrated embodiment are arranged in a row that extends along a center-point of the spacer's width 400, although this is not required in all embodiments. Referring to FIGS. 1 and 2, the illustrated flats 35 are each rectangular in shape, although this too is not required.

As best seen in FIG. 2, each flat 35 in the first corrugation field 11 has a longitudinal dimension (e.g., a length measured along the spacer's length direction) substantially matching the longitudinal dimension of a single corrugation (e.g., the structure extending from one valley to the next) in the second set of corrugations 122. The peaks 31 of the corrugations in the first corrugation field 11 are aligned with (e.g., are continuous with) peaks 38 of corresponding corrugations in the second corrugation field 12, and for every third peak in the second corrugation field there is no corresponding peak in the first corrugation field; instead, there is a corresponding flat 35. These particular details, however, are by no means limiting to the invention.

In FIGS. 1-4, the first corrugation field 11 has two corrugations (e.g., two corrugation peaks 31) between each two adjacent flats 35. Alternatively, there could be a single corrugation (or three corrugations, or four corrugations, etc.) between each two adjacent flats.

In the embodiment of FIGS. 1-4, the engineered wall 15 has three corrugation fields—the noted first 11 and second 12 corrugation fields, as well as a third corrugation field 13. Here, the second 12 and third 13 corrugation fields are located adjacent to respective lateral sides of the engineered wall 15, and the first corrugation field 11 is located between the second and third corrugation fields. In embodiments of this nature, the centrally located first corrugation field 11 preferably includes larger corrugations than corrugations in the outer second 12 and third 13 corrugation fields. In the illustrated embodiment, the second 12 and third 13 corrugation fields have corrugations of the same configuration (e.g., of the same size, shape, and frequency), while the first corrugation field 11 has corrugations that are configured differently than the corrugations of the second and third corrugation fields. Thus, the size, shape, and frequency of the third set of corrugations 133 are the same as those described above for the second set of corrugations 122. This, however, is not required in all embodiments. For example, the second corrugation field 12 could alternatively have corrugations configured differently than the corrugations of the third corrugation field 13. Moreover, the engineered wall can include more than three corrugation fields, if so desired.

As can be seen in FIGS. 1, 2A, 2C, 3, 4, and 5, although the engineered wall 15 has multiple corrugation fields, it still has a generally planar configuration in the embodiment illustrated. Thus, all the corrugation fields of the illustrated wall 15 lie in the same general plane.

As further described below, the illustrated spacer 10 has a tubular configuration with side walls 16 and an outer wall 17 in addition to the engineered wall 15. While this type of configuration will commonly be preferred, the invention is not so limited. For example, the spacer can take many different forms, provided it includes at least one engineered wall 15 of the nature described here. In certain alternate embodiments, the engineered wall is one of two generally flat strips that are not bent so as to be joined together, but rather are connected by means of a filler, separate side walls, or both.

The spacer 10 preferably comprises, consists essentially of, or consists of metal. Stainless steel is a preferred wall material due to its strength and heat transfer characteristics. Thus, the spacer 10 can advantageously be formed entirely of stainless steel. Another option is forming the spacer of a titanium alloy. If desired, the first metal strip 700 (which in the illustrated embodiment defines the channel member) can be formed of a different material than the second metal strip 900 (which in the illustrated embodiment defines the engineered wall 15). For example, the first metal strip 700 can be formed of a first metal (such as stainless steel), and the second metal strip 900 can be formed of a second metal (such as a titanium alloy or another metal).

The engineered wall 15 of the spacer 10 is extremely thin so as to minimize the heat transfer along this wall. The thickness of the engineered wall 15, for example, can be less than 0.005 inch, such as less than 0.004 inch, preferably less than 0.003 inch, such as about 0.002 inch. In some embodiments, the thickness of the engineered walls 15 is less than 0.002 inch, such as about 0.0015 inch.

Figure 3:
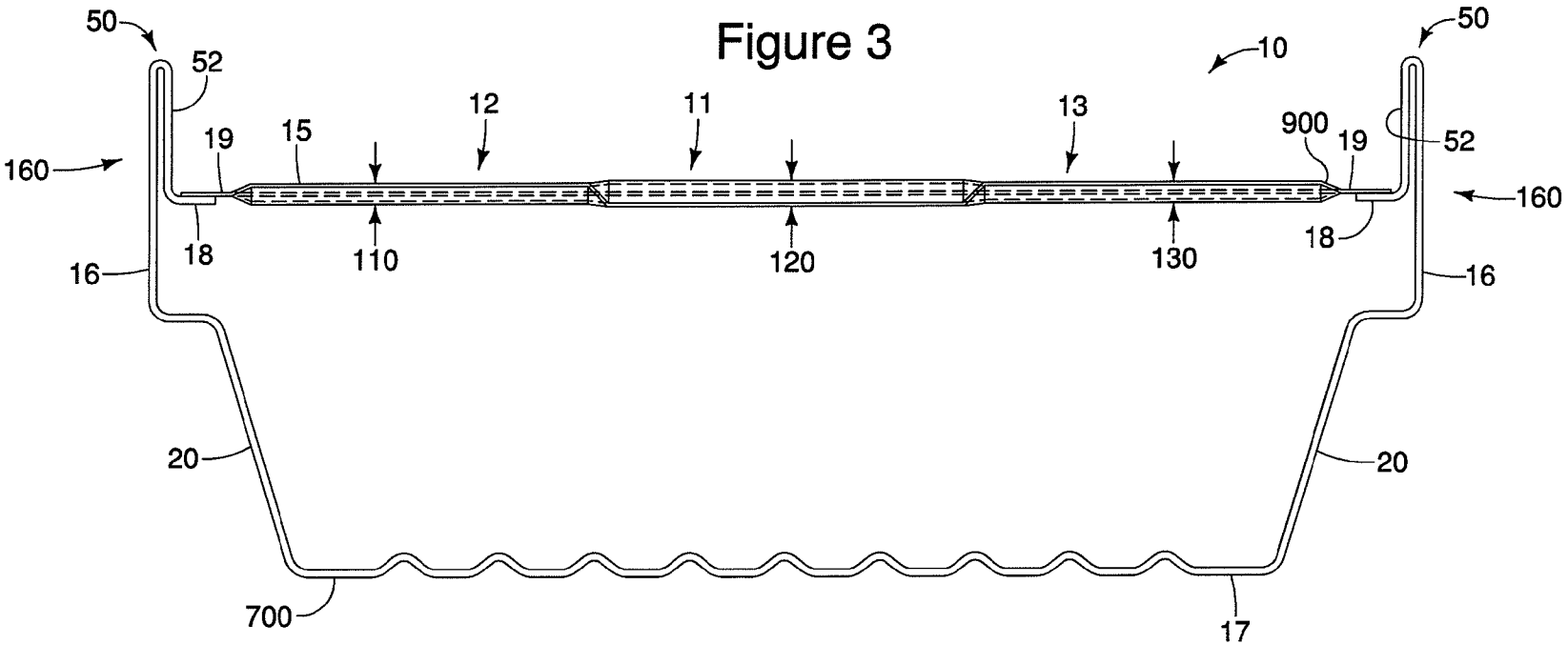
FIG. 3 is an end view of the spacer of FIG. 1.
Figure 4:
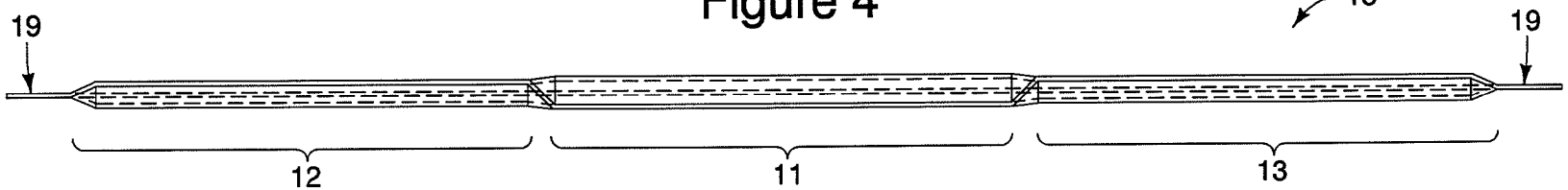
FIG. 4 is an end view of the top wall of FIG. 2.

Referring now to FIGS. 3 and 4, the illustrated wall 15 has a non-corrugated, flat side region 19 defining each lateral edge of the wall. These two flat side regions 19 are located laterally outward of the corrugations on the engineered wall 15. In other words, the corrugations on the engineered wall 15 are located between the two flat side regions 19. While this is not required in all embodiments, it can be advantageous for mounting purposes when the spacer is formed of two separate strips, as will now be described.

As best seen in FIG. 3, the illustrated spacer embodiment comprises a first metal strip 700 defining a channel member (optionally being generally U-shaped or generally W-shaped) and a second metal strip 900 defining the engineered wall 15. The second metal strip 900 defines both the first 11 and second 12 corrugation fields, as well as the third corrugation field 13, when provided. Each metal strip 700, 900 preferably is a single integral piece of metal. In the illustrated embodiment, the first metal strip 700 has a greater thickness than the second metal strip 900. The thickness of the first metal strip 700, for example, can be more than 50% greater than (optionally at least twice as great as) the thickness of the second metal strip 900. In one non-limiting example, the thickness of the first metal strip 700 is about 0.0045 inch, and the thickness of the second metal strip 900 is about 0.002 inch. These details are by no means limiting to the invention.

Figure 5:
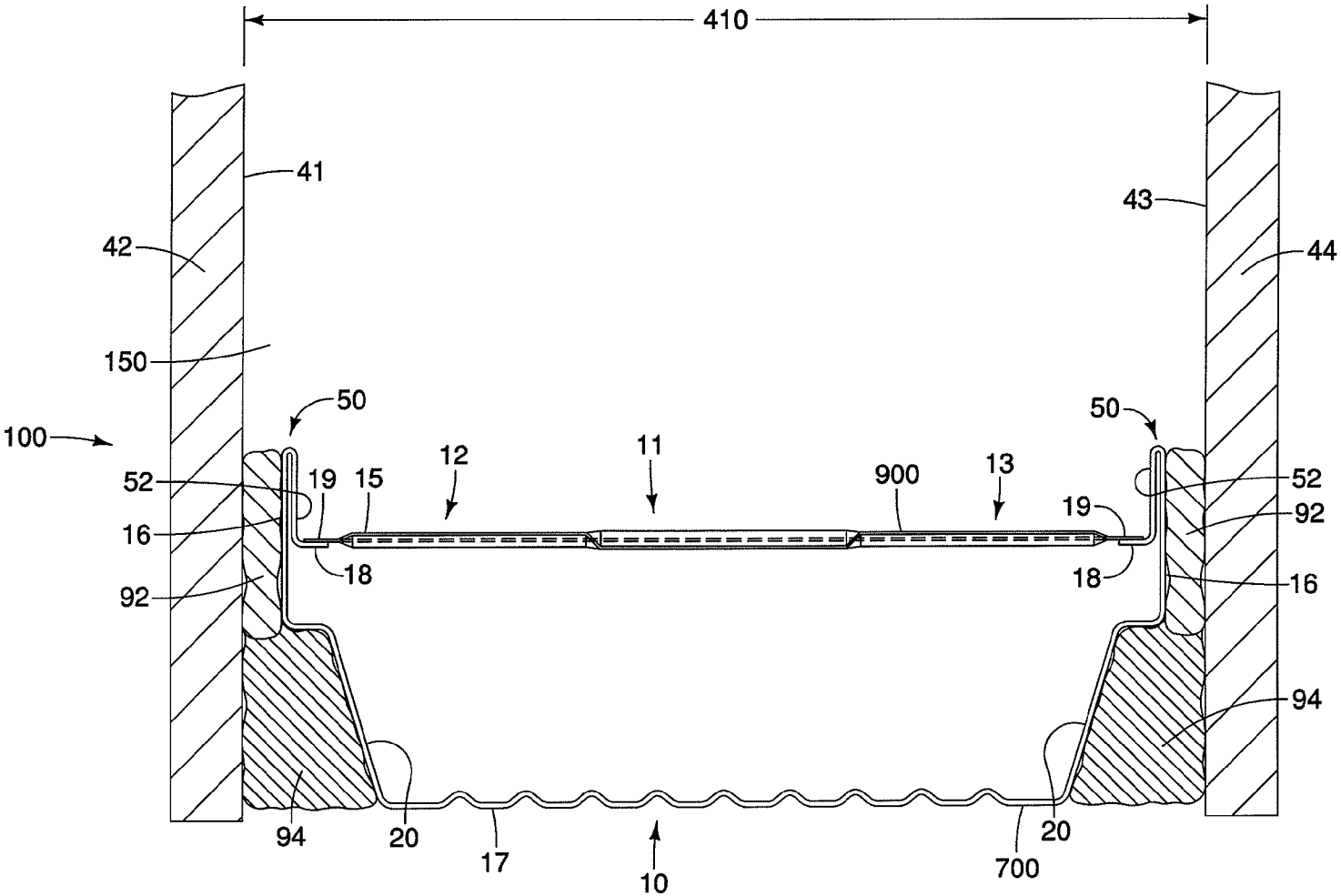
FIG. 5 is a cross-sectional view of a multi-pane glazing unit having a spacer and seal system in accordance with another embodiment of the invention.

In the illustrated spacer embodiment, the engineered wall 15 serves as an inner wall of the spacer 10 (i.e., a wall that, when the spacer is incorporated into a glazing unit 100, is exposed to a between-pane space 150 of the unit). Referring to FIG. 3, it can be seen that the illustrated spacer 10 also includes an outer wall 17 and two side walls 16. The side walls 16 can optionally be opposed, flat sidewalls that are generally parallel to each other. The side walls 16 preferably are adapted to receive a sealant 92, as shown in FIG. 5. The outer wall 17 in the illustrated embodiment includes a series of lengthwise corrugations (i.e., corrugations elongated along the length 500 of the spacer 10). It is to be appreciated, however, that these lengthwise corrugations are optional, and thus can be omitted. More generally, the outer wall 17 of the spacer 10 can be provided in many different configurations. For example, it can take a generally W-shaped form, as shown in FIGS. 4, 5, 6, and 10 of U.S. Pat. No. 5,439,716, or a generally U-shaped form, as shown in FIG. 2 of that patent. The teachings of the noted '716 patent concerning the shape of the outer wall are hereby incorporated by reference herein.

Referring now to FIG. 5, the side walls 16 of the illustrated spacer 10 extend generally inwardly of the between-pane space 150 (upwardly in FIG. 5) and are then bent back upon themselves at 50 to form wall sections 52 that extend parallel to the side walls. These wall sections 52 terminate in inwardly turned lips 18 that extend toward each other a short distance across the interior of the spacer. The engineered wall 15 rests along its side regions 19 on the inwardly turned lips 18, and preferably is welded to the lips 18. By welding or otherwise joining these overlap seams at longitudinally spaced-apart points, tiny breathing spaces can be provided between the resulting weldments or other connection points. In one non-limiting example, the welding is done using pulsed laser welding of 20-25 weldments per inch. In other cases, adhesive is used instead of welding. By spacing the weldments or other connection points from one another, gaseous communication of the between-pane space 150 with the interior of the spacer 10 is provided. In such cases, the interior of the spacer 10 can advantageously be filled with a particulate desiccant composition or any other suitable form of desiccant. Various desiccants can be used, including particulate silica gel, molecular sieves (a refined version of naturally occurring zeolites), or the like. Molecular sieves sold by W. R. Grace & Co. under its trade designation LD-3 are suitable; this material is available in the form of small spherical particles, 16-30 mesh, having pores approximately 3 angstroms in diameter. Thus, desiccant preferably is provided within the spacer 10 and is able to extract water vapor from the between-pane space 150. Additionally or alternatively, desiccant can be incorporated into a sealant 92 used with the spacer 10. Another suitable option is to provide a desiccant matrix in or on the spacer.

The first step in manufacturing the spacer of FIGS. 1-4 is forming the patterned top wall. This is done by passing a continuous strip through tooling designed to impart the desired pattern into the strip. This tooling is in the form of upper and lower rollers, having mating patterns so that when the strip passes between the rotating tools, the pattern present on the tools is pressed into the strip. This can be done using either a single set of pattern rolls, or multiple sets of pattern rolls, depending on the style and complexity of the desired pattern.

The spacer bottom channel is roll formed using traditional roll forming equipment and practices. In this process a coiled strip is uncoiled and passed through various sets of roll forming tooling, where each set of upper and lower tools forms the strip in an additive fashion until the finished geometry is reached. At this point the patterned top strip is assembled onto the spacer bottom channel in a continuous manner and attached. For the particular spacer geometry shown in FIGS. 1-4, the top strip is laid into place within the spacer bottom channel where it rests on the inwardly turned lips (or "platforms"), and is affixed using spaced apart welds. These welds can be formed using a laser energy source, but could also be welded using electrical resistance or other methods. Adhesive attachment could also be used.

After attaching the corrugated top, the finished spacer geometry is cut to the desired length using a moving cut off saw or die. This allows the spacer to be produced in a continuous fashion, yet still be cut to accurate finished lengths for packaging and final use.

In another embodiment, the invention provides a multi-pane glazing unit 100 that includes a spacer 10 with an engineered wall 15. Various configurations have already been described for the spacer 10 having the engineered wall 15. The glazing unit 100 can be an insulating glass unit, and the first 42 and second 44 panes can be glass. The glazing unit 100, however, can take other forms. For example, it can be a photovoltaic unit, a spandrel, or another type of multi-pane glazing. In some embodiments where the glazing unit 100 is an insulating glass unit, the between-pane space 150 of the unit is filled with insulative gas mix (argon, an argon/air mix, krypton, a krypton/air mix, etc.). In other embodiments, the between-pane space 150 is evacuated (e.g., the unit can be a vacuum glazing unit). Moreover, while FIGS. 5 and 6 depict a double-pane unit 100, the glazing unit can alternatively have three or more panes, and thus two or more between-pane spaces.

Figure 6:
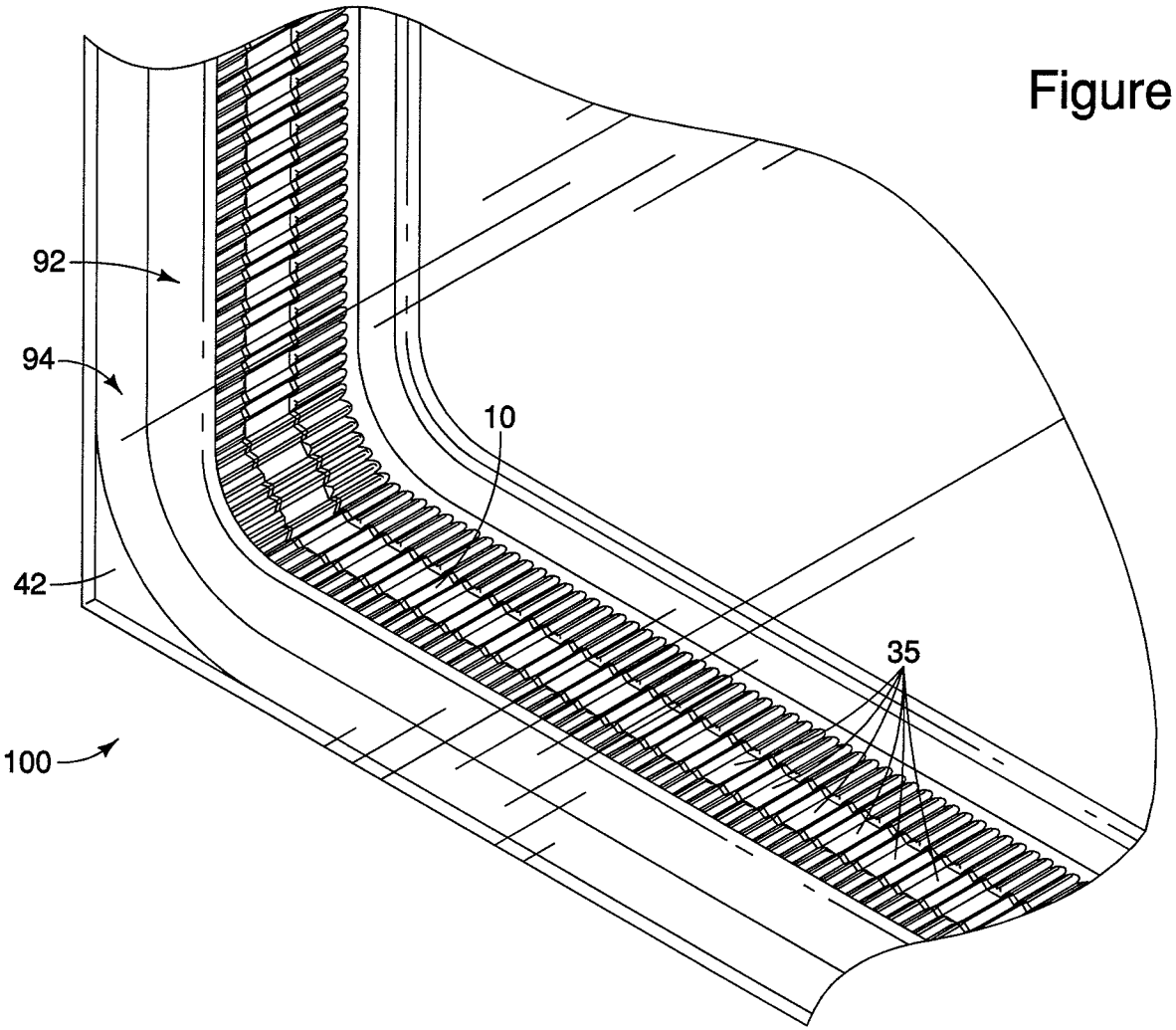
FIG. 6 is broken-away perspective view of the multi-pane glazing unit of FIG. 5.

In FIGS. 5 and 6, the multi-pane glazing unit 100 includes first 42 and second 44 panes maintained in a spaced-apart configuration by a spacer 10 located between the first and second panes. The glazing unit 10 includes a between-pane space 150 having a width 410. As is well known, the width 410 of the between-pane space 150 will vary depending upon the application intended for the glazing unit 100. The first 42 and second 44 panes have confronting surfaces 41, 43 facing (e.g., exposed to) the between-pane space 150. The spacer 10 has two side regions (e.g., side walls or side edges) sealed to or otherwise held against edge regions of the confronting pane surfaces 41, 43. The spacer 10 has an engineered wall 15 that extends in a widthwise direction relative to the between-pane space 150. As already described, the engineered wall 15, in moving widthwise along the engineered wall, comprises multiple corrugation fields including a first corrugation field 11 and a second corrugation field 12. These corrugation fields have different configured patterns. Preferably, the first corrugation field 11 has a first set of widthwise corrugations 111, and the second corrugation field 12 has a second set of widthwise corrugations 122. The first set of corrugations 111 comprises corrugations that are configured differently than corrugations of the second set of corrugations 122. In connection with the details of the spacer 10 used in the present glazing unit embodiment, reference is made to the detailed spacer descriptions provided above with regard to FIGS. 1-4.

In FIGS. 5 and 6, the spacer 10 is used to support and space apart a pair of generally parallel panes 42, 44. The spacer 10 is positioned adjacent the periphery of the panes. The illustrated spacer 10 is generally tubular in cross-section, although as noted above, this is not required in all embodiments. In some cases, the spacer 10 is formed using rolling techniques (such as those described above) or other metal-forming techniques. In the embodiment of FIG. 5, the spacer 10 has an engineered inner wall 15 facing the between-pane space 150, and an outer wall 17 facing away from the between-pane space. Side walls 16 are provided with flat outer surfaces that are parallel to the confronting pane surfaces 41, 43. A separate flexible seal 92 bonds the flat surfaces of the spacer's side walls 16 to the confronting surfaces 41, 43 of the panes 42, 44.

With continued reference to FIG. 5, the spacer 10 includes angled wall portions 20 that extend outwardly in a convergent manner from the respective pane surfaces 41, 43 and form, together with the pane surfaces, a pair of recesses for receiving sealant 94. These recesses can be relatively deep and narrow, with the depth (measured parallel to the pane surfaces 41, 43) optionally exceeding the width (measured normal to the pane surfaces). The actual configurations of these recesses can be varied as desired (and can even be omitted in some embodiments). When provided, each such recess is defined collectively by one of the confronting pane surfaces 41, 43 and a wall portion 20 of the spacer.

In the manufacturing process, the spacer 10 is first fabricated to the desired cross section (as described above) and is thereafter bent into a generally rectangular shape to follow the periphery of the panes. It will be appreciated by skilled artisans that, if the glazing unit is a shape other than rectangular, then the spacer will be bent into a corresponding non-rectangular shape. Desiccant 20 can advantageously be inserted into the tubular spacer 10 before it is bent and joined end to end. Another well known option is to fill the spacer with desiccant after bending. Preferably, the outer wall 17 of the resulting spacer is spaced inwardly slightly from the edges of the panes 42, 44. A sealant (such as polyisobutylene sealant, optionally carbon-filled) can be extruded as a soft, pliant ribbon or bead onto each of the flat wall surfaces of the spacer's side walls 16. The spacer 10 is positioned against a first pane 42, and a second pane 44 is placed on the other side of the spacer. The resulting between-pane space 150 will commonly be filled with insulative gas (argon, an air/argon mix, krypton, an air/krypton mix, etc.) using well known gas filling techniques. The two panes 42, 44 are then forced together so as to compress the polyisobutylene or other sealant beads into flat ribbons as shown at 92 in FIGS. 5 and 6. The resulting glazing unit 100 thus has a pair of spaced recesses bounded, respectively, by the confronting surfaces 41, 43 of the panes 42, 44 and wall portions 20 of the spacer 10. Preferably, these recesses are then filled with silicone or another suitable sealant 94 using well known sealant application techniques.

While a preferred embodiment of the present invention has been described, it should be understood that various changes, adaptations and modifications may be made therein without departing from the spirit of the invention and the scope of the appended claims.

What is claimed is:

1. A multi-pane glazing unit comprising first and second panes maintained in a spaced-apart configuration by a spacer located between the first and second panes, the glazing unit having at least one between-pane space with a width, the first and second panes having confronting surfaces exposed to said between-pane space, the between-pane space being a gas or vacuum gap located inwardly of the spacer and defined by the confronting surfaces of the first and second panes such that the between-pane space is devoid of another pane, the spacer having a length and a width, the width of the spacer corresponding to the width of the between-pane space, the spacer having two side regions defining opposed ends of the spacer that are sealed respectively to said confronting surfaces of the first and second panes, the spacer having an engineered wall that extends across the width of the between-pane space so as to be substantially perpendicular to said confronting surfaces of the first and second panes, wherein the engineered wall, in moving widthwise along the engineered wall, comprises multiple corrugation fields including a first corrugation field and a second corrugation field, the first corrugation field having a first set of widthwise corrugations, the second corrugation field having a second set of widthwise corrugations, said first set of corrugations comprising corrugations that are sized differently than corrugations of said second set of corrugations, said first set of corrugations having a greater corrugation height than said second set of corrugations, such that a single wall of the spacer has multiple corrugation fields that respectively have differently sized corrugations, said single wall of the spacer being the engineered wall.

2. The multi-pane glazing unit of claim 1 wherein said first set of corrugations comprises corrugations that are at least 0.002 inch larger than corrugations of said second set of corrugations.

3. The multi-pane glazing unit of claim 1 wherein said second set of corrugations has a higher corrugation frequency than said first set of corrugations.

4. The multi-pane glazing unit of claim 3 wherein said corrugation frequency of said second set of corrugations is at least 20% higher than that of said first set of corrugations.

5. The multi-pane glazing unit of claim 1 wherein said first corrugation field includes a series of flats, each of said flats being located between two adjacent corrugation peaks.

6. The multi-pane glazing unit of claim 5 wherein each flat has a longitudinal dimension substantially matching that of a single corrugation in said second set of corrugations.

7. The multi-pane glazing unit of claim 1 wherein said first and second corrugation fields lie in the same general plane such that the engineered wall is substantially perpendicular to said confronting surfaces of said first and second panes.

8. The multi-pane glazing unit of claim 1 wherein the spacer consists of metal.

9. The multi-pane glazing unit of claim 1 wherein the spacer comprises a first metal strip defining a channel member, and the spacer comprises a second metal strip defining said engineered wall, such that said second metal strip defines both said first and second corrugation fields.

10. The multi-pane glazing unit of claim 9 wherein the channel member comprises two opposed, flat side walls that respectively define the two side regions of the spacer.

11. The multi-pane glazing unit of claim 9 wherein the first metal strip is more than 50% thicker than the second metal strip.

12. The multi-pane glazing unit of claim 11 wherein the first metal strip is at least twice as thick as the second metal strip.

13. The multi-pane glazing unit of claim 1 wherein the multi-pane glazing unit is an insulating glass unit, and said first and second panes are glass.

14. The multi-pane glazing unit of claim 1 wherein the glazing unit is a triple glazing having three panes and two between-pane spaces.

15. The multi-pane glazing unit of claim 1 wherein the first corrugation field and the second corrugation field each comprise corrugations that are generally trapezoidal, triangular, arcuate, square, rectangular, or generally follow a sine wave.

16. The multi-pane glazing unit of claim 1 wherein the corrugations of the first and second corrugation fields have peaks and valleys that are elongated in a lateral direction to as to extend straight across the width of the spacer.

17. The multi-pane glazing unit of claim 1 wherein the first corrugation field has peaks that are continuous with peaks of corresponding corrugations in the second corrugation field even though said peaks of the first corrugation field are of greater height than said peaks of the second corrugation field.

18. The multi-pane glazing unit of claim 1 wherein the second corrugation field is corrugated on a continuous uninterrupted basis along the length of the spacer, whereas the first corrugation field has a series of non-corrugated wall regions spaced apart along the length of the spacer.

19. The multi-pane glazing unit of claim 1 wherein the multi-pane glazing unit is a double glazing unit having only two panes, namely said first and second panes.

20. The multi-pane glazing unit of claim 1 wherein the engineered wall has a thickness of less than 0.004 inch.

21. The multi-pane glazing unit of claim 1 wherein the engineered wall has two lateral edges each defined by a non-corrugated, flat side region, said two flat side regions located laterally outward of the multiple corrugation fields of the engineered wall.

22. A spacer for a multi-pane glazing unit, the spacer having a length and a width, the spacer having an engineered inner wall, an outer wall, and two side walls, the engineered inner wall extending in a widthwise direction, wherein the engineered inner wall, in moving in said widthwise direction along the engineered inner wall, comprises multiple corrugation fields including a first corrugation field and a second corrugation field, the first corrugation field having a first set of widthwise corrugations, the second corrugation field having a second set of widthwise corrugations, and wherein said first set of corrugations comprises corrugations that are sized differently than corrugations of said second set of corrugations, the corrugations of said first and second sets being elongated in a direction substantially normal to the two side walls of the spacer, said first set of corrugations having both a greater corrugation height and a lower corrugation frequency than said second set of corrugations, such that a single wall of the spacer has multiple corrugation fields that respectively have corrugations of different size and frequency, said single wall of the spacer being the engineered inner wall.

23. The spacer of claim 22 wherein said first set of corrugations comprises corrugations that are at least 0.002 inch larger than corrugations of said second set of corrugations.

24. The spacer of claim 22 wherein said corrugation frequency of said second set of corrugations is at least 20% higher than that of said first set of corrugations.

25. The spacer of claim 22 wherein said first corrugation field includes a series of flats, each of said flats being located between two adjacent corrugation peaks.

26. The spacer of claim 25 wherein each flat has a longitudinal dimension substantially matching that of a single corrugation in said second set of corrugations.

27. The spacer of claim 22 wherein said first and second corrugation fields lie in the same general plane such that the engineered inner wall is substantially perpendicular to the two side walls of the spacer.

28. The spacer of claim 22 wherein the spacer consists of metal.

29. The spacer of claim 22 wherein the spacer comprises a first metal strip defining a channel member, and the spacer comprise a second metal strip defining said engineered wall, such that said second metal strip defines both said first and second corrugation fields.

30. The spacer of claim 22 wherein the first corrugation field and the second corrugation field each comprise corrugations that are generally trapezoidal, triangular, arcuate, square, rectangular, or generally follow a sine wave.

31. The spacer of claim 22 wherein the engineered wall has three corrugation fields including said first and second corrugation fields as well as a third corrugation field, said second and third corrugation fields being located adjacent to respective lateral sides of the engineered wall, said first corrugation field being located between said second and third corrugation fields.

32. The spacer of claim 31 wherein said second and third corrugation fields have corrugations of the same configuration, while said first corrugation field has corrugations that are configured differently than the corrugations of said second and third corrugation fields.

33. The spacer of claim 22 wherein the spacer comprises a first metal strip defining a channel member, and a second metal strip defining the engineered inner wall, such that said second metal strip defines both said first and second corrugation fields, and the channel member defines the two side walls of the spacer, the two side walls of the spacer being opposed, flat side walls.

34. The spacer of claim 22 wherein the corrugations of the first and second corrugation fields have peaks and valleys that are elongated in a lateral direction to as to extend straight across the width of the spacer.

35. The spacer of claim 22 wherein the second corrugation field is corrugated on a continuous uninterrupted basis along the length of the spacer, whereas the first corrugation field has a series of non-corrugated wall regions spaced apart along the length of the spacer.

36. The spacer of claim 22 wherein the engineered wall has a thickness of less than 0.002 inch.

* * * * *